US012297401B2

(12) United States Patent
DeBlase

(10) Patent No.: US 12,297,401 B2
(45) **Date of Patent: *May 13, 2025**

(54) ORGANIC ANTI-WEAR ADDITIVE COMPOSITIONS FOR LUBRICANTS

(71) Applicant: LANXESS Corporation, Pittsburgh, PA (US)

(72) Inventor: Frank J. DeBlase, Hopewell Junction, NY (US)

(73) Assignee: LANXESS Corporation, Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/267,156

(22) PCT Filed: Dec. 13, 2021

(86) PCT No.: PCT/US2021/063033

§ 371 (c)(1),
(2) Date: Jun. 14, 2023

(87) PCT Pub. No.: WO2022/140094

PCT Pub. Date: Jun. 30, 2022

(65) Prior Publication Data

US 2024/0059998 A1 Feb. 22, 2024

Related U.S. Application Data

(60) Provisional application No. 63/128,528, filed on Dec. 21, 2020.

(51) Int. Cl.

| | |
|---|---|
| ***C10M 145/22*** | (2006.01) |
| ***C10M 129/76*** | (2006.01) |
| ***C10M 133/16*** | (2006.01) |
| *C10N 30/06* | (2006.01) |

(52) U.S. Cl.

CPC ..... *C10M 145/22* (2013.01); *C10M 129/76* (2013.01); *C10M 133/16* (2013.01); *C10M 2207/30* (2013.01); *C10M 2209/102* (2013.01); *C10M 2215/082* (2013.01); *C10N 2030/06* (2013.01)

(58) Field of Classification Search

CPC ..... C10M 145/22; C10M 129/76; C10M 133/16; C10M 2207/30; C10M 2209/102; C10M 2215/082; C10M 2207/282; C10M 157/04; C10N 2030/06

See application file for complete search history.

(56) References Cited

U.S. PATENT DOCUMENTS

| | | | | |
|---|---|---|---|---|
| 5,498,809 | A | 3/1996 | Emert et al. | |
| 7,696,136 | B2 | 4/2010 | Migdal et al. | |
| 9,562,207 | B2 | 2/2017 | DeBlase et al. | |
| 11,286,441 | B2 * | 3/2022 | DeBlase | C10M 145/22 |
| 2015/0376537 | A1 * | 12/2015 | DeBlase | C10M 133/16 508/555 |
| 2021/0040411 | A1 | 2/2021 | DeBlase et al. | |

FOREIGN PATENT DOCUMENTS

| | | | | |
|---|---|---|---|---|
| WO | WO-2019157350 A2 * | 8/2019 | | C10M 129/72 |

OTHER PUBLICATIONS

International Search Report from corresponding International Application No. PCT/US2021/063033, dated Mar. 17, 2022, two pages.

* cited by examiner

*Primary Examiner* — Cephia D Toomer
(74) *Attorney, Agent, or Firm* — Nicanor A. Kohncke; Christopher L. McDavid; Ewa M. Wozniak

(57) ABSTRACT

Improved organic anti-wear additive compositions are disclosed containing certain citric acid esters, e.g., mixtures comprising citrate oligomers, and fatty acid alkanolamides. The combination exhibits excellent and synergistic anti-wear activity in lubricants. The compositions of the invention beneficially allow one to reduce amounts of zinc and phosphorus that are often used in lubricants, while boosting anti-wear performance and maintaining, and often enhancing, friction reduction properties.

22 Claims, No Drawings

ORGANIC ANTI-WEAR ADDITIVE COMPOSITIONS FOR LUBRICANTS

A variety of additives have been developed to improve the lifetime and effectiveness of lubricants, such as engine oils. These additives include antioxidants, anti-wear agents, deposit control agents, friction modifiers, additives to improve lubricity and load bearing properties, etc. Some additives serve more than one function, for example, zinc dialkyldithiophosphates (ZDDP) have been used as anti-fatigue, anti-wear, antioxidant, extreme pressure and friction modifying agents for lubricating oils for many years. However, ZDDP is subject to several drawbacks due to the presence of zinc and phosphorus.

Zinc dihydrocarbyldithiophosphate is a general term that includes zinc dialkyldithiophosphates, zinc diaryldithiophosphates, zinc alkylaryldithiophosphates and combinations thereof. ZDDP has been used as an anti-wear additive in formulated oils for more than 50 years. However, zinc dihydrocarbyldithiophosphates give rise to ash, which contributes to particulate matter in automotive exhaust emissions, and regulatory agencies are seeking to reduce emissions of zinc into the environment. In addition, phosphorus, also a component of ZDDP, is suspected of limiting the service life of the catalytic converters that are used in cars to reduce pollution. Due to these drawbacks, attempts continue to be made to develop fully organic additives that can replace at least a portion of ZDDP. While it is important to limit particulate matter and pollution formed during engine use for toxicological and environmental reasons, it is also important to maintain undiminished the anti-wear properties of the lubricating oil.

International Patent Publication No. WO 2019/157350 discloses certain citrate and citramide compounds, such as citrate dimers, trimers, higher oligomers and mixtures thereof, as anti-wear and friction modifying additives for lubricant compositions. The disclosed citrate and citramide compounds were shown to exhibit synergy in combination with zinc dihydrocarbyldithiophosphates, allowing one to reduce the amounts of zinc and phosphorus, such as by reducing the amount of ZDDP, often used in lubricants without sacrificing anti-wear performance. Despite these advancements, efforts continue to develop fully organic additive compositions to improve anti-wear performance and reduce the amount of zinc and phosphorus in lubricant compositions.

In accordance with the present disclosure, it has been found that organic anti-wear additive compositions containing certain citrate compounds as described herein, such as citrate dimers, trimers, higher oligomers and mixtures thereof, combined with fatty acid alkanolamides surprisingly exhibit synergistic anti-wear performance, which allows for reductions in the level of zinc dihydrocarbyldithiophosphates, such as ZDDP, in lubricant compositions. Moreover, whereas use of conventional levels of ZDDP in lubricant compositions may lead to degradation of friction reduction properties, use of the presently disclosed synergistic combination leads to enhanced friction reduction. In addition, further enhanced anti-wear performance is observed when the organic anti-wear additive composition of the present disclosure is combined with zinc dihydrocarbyldithiophosphates, allowing for further reductions in the levels of zinc and phosphorus in lubricant compositions.

In particular, there is disclosed an anti-wear additive composition comprising (a) one or more citrate compounds of formula I, formula II, formula III or mixtures thereof and (b) one or more fatty acid alkanolamide compounds of formula IV as described herein. In many embodiments, the ratio by weight of the citrate component (a) to the fatty acid alkanolamide component (b) is from 8:1 to 1:8, such as from 6:1 to 1:6, from 5:1 to 1:5, from 4:1 to 1:4, from 3.5:1 to 1:3.5, from 3:1 to 1:3, from 2:1 to 1:2, from 1.5:1 to 1:1.5, or about 1:1.

The citrate compounds of the present disclosure are represented by formulas I, II and III as follows:

I

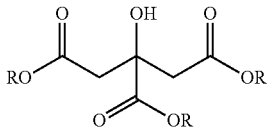

II

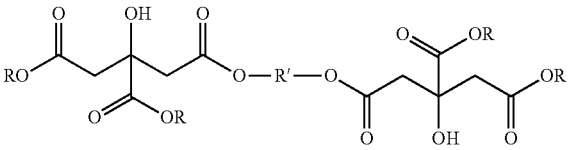

III

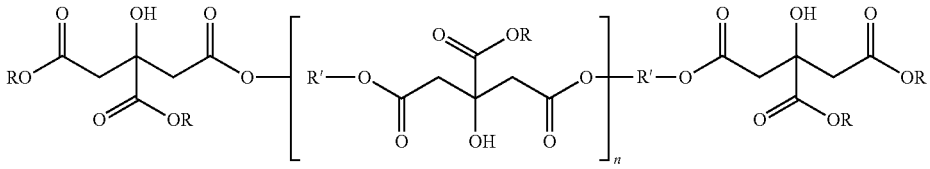

wherein R is an alkyl group that may be interrupted by —O—, carbonyl, carbonyloxy, carbocycle or heterocycle, and/or substituted by OH, carbocycle or heterocycle, R' is an alkylene group that may be interrupted by —O—, carbonyl, carbonyloxy, carbocycle or heterocycle, and/or substituted by OH, carbocycle or heterocycle;

and n is 1 to 20.

Unless otherwise specified, the alkyl or alkylene group may be linear, branched or cyclic, and the carbocycle or heterocycle may be monocycle, bicycle or polycycle and may be further substituted by alkyl.

The present disclosure also provides a lubricant composition comprising A) a lubricating oil, B) from 0.1 to 5 wt %, based on the weight of the lubricant composition, of one or more citrate compounds of formula I, formula II, formula III or mixtures thereof, and C) from 0.1% to 5 wt %, based on the weight of the lubricant composition, of one or more fatty acid alkanolamides. In many embodiments, the ratio by weight of the citrate component B) to the fatty acid alkanolamide component C) is from 8:1 to 1:8, such as from 6:1 to 1:6, from 5:1 to 1:5, from 4:1 to 1:4, from 3.5:1 to 1:3.5, from 3:1 to 1:3, from 2:1 to 1:2, from 1.5:1 to 1:1.5, or about 1:1.

Many embodiments of the present disclosure relate to citrate compounds of formula II or III, or mixtures of citrate compounds of formulas II and III. Other embodiments relate to certain citrate compounds of formula I, for example, compounds of formula I where R is a carbocycle or heterocycle, alkyl substituted by carbocycle or heterocycle, or alkyl interrupted by —O—, such as a polyether, for example, tris benzyl, tris norbornane methyl, trisadamantyl, tris tetrahydrofurfuryl, or tris triethylene glycol monomethyl ether esters of citric acid, and the like. Such compounds of formula I may be used with or without other citrates.

Further embodiments of the presently disclosed lubricant compositions comprise zinc dihydrocarbyldithiophosphate, such as zinc dialkyldithiophosphate (ZDDP).

Throughout the present application, "a" or "an" means one or more than one unless indicated otherwise.

The organic anti-wear additive composition of the present disclosure exhibits synergistic anti-wear performance. That is, at the same total load level, the anti-wear activity of the present combination of citrate compounds and fatty acid alkanolamides exceeds the activity of the citrate compounds and fatty acid alkanolamides when each is used alone. The excellent activity of the presently disclosed combination allows one to reduce the amount of ZDDP present in lubricants, while boosting anti-wear performance and maintaining, and often enhancing, friction reduction properties.

Citrate compounds employed in the compositions of the present disclosure are those of formula I, formula II and/or formula III:

$C_{2-18}$ alkyl interrupted by one or more —O—, carbonyl or carbonyloxy and substituted by a carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy; and R' is $C_{2-18}$ alkylene;

$C_{2-18}$ alkylene interrupted by one or more —O—, carbonyl or carbonyloxy and/or substituted by OH, a carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or said alkylene, interrupted alkylene or substituted alkylene interrupted by a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy.

For example, compounds of formula I, formula II and/or formula III wherein:

R is $C_{1-18}$ alkyl, $C_{1-12}$ alkyl or $C_{1-6}$ alkyl, said alkyl substituted by a carbocycle comprising 5 to 12 carbon atoms or a heterocycle comprising 3 to 8 carbon atoms and one or more heteroatoms selected from O, S and N,

I

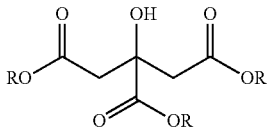

II

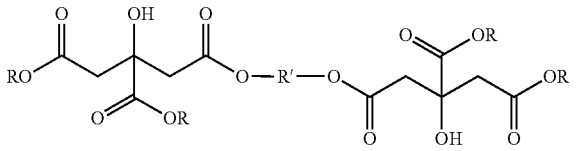

III

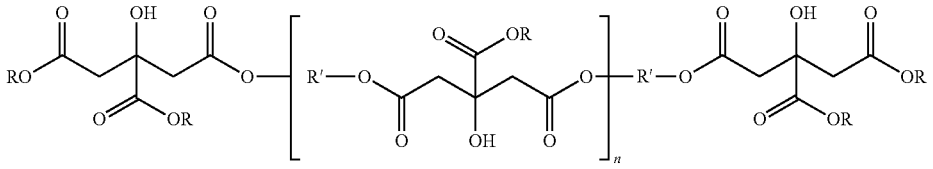

wherein:

n is 1 to 20, e.g., 1 to 10, 1 to 5, or 1 to 3;

R is $C_{1-18}$ alkyl;

$C_{1-18}$ alkyl substituted by a carbocycle comprising 5 to 12 carbon atoms or a heterocycle comprising 3 to 11 carbon atoms and one or more heteroatoms selected from O, S and N, wherein the carbocycle or the heterocycle may be substituted by one or more $C_{1-12}$ alkyl or alkyloxy;

$C_{2-18}$ alkyl interrupted by one or more —O—, carbonyl, carbonyloxy and/or substituted by OH; wherein the carbocycle or the heterocycle may be substituted by one or more $C_{1-8}$ alkyl or alkyloxy;

$C_{2-18}$ alkyl, $C_{2-12}$ alkyl or $C_{2-8}$ alkyl interrupted by one or more —O—, carbonyl, carbonyloxy and/or substituted by a carbocycle comprising 5 to 12 carbon atoms or a heterocycle comprising 3 to 8 carbon atoms and one or more heteroatoms selected from O, S and N, wherein the carbocycle or heterocycle may be substituted by $C_{1-8}$ alkyl or alkyloxy; or carbocycle comprising 5 to 12 carbon atoms, or a heterocycle comprising 3 to 8 carbon atoms and one or more heteroatoms selected from O, S and N, wherein the carbocycle or heterocycle may be substituted by $C_{1-8}$ alkyl or alkyloxy; and R' is $C_{2-16}$ alkylene, $C_{2-12}$ alkylene or $C_{2-8}$ alkylene, said alkylene interrupted by one or more —O—, carbonyl or carbonyloxy and/or substituted by OH, a carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-8}$ alkyl or alkyloxy; or said alkylene, interrupted alkylene or substituted alkylene interrupted by a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-8}$ alkyl or alkyloxy.

In many embodiments of the present disclosure, the antiwear additive composition comprises:

(a) a citrate compound of formula II

II

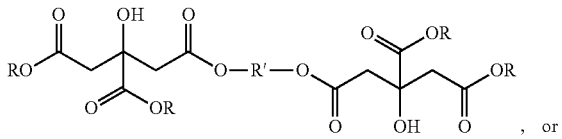

, or a citrate compound of formula III

III

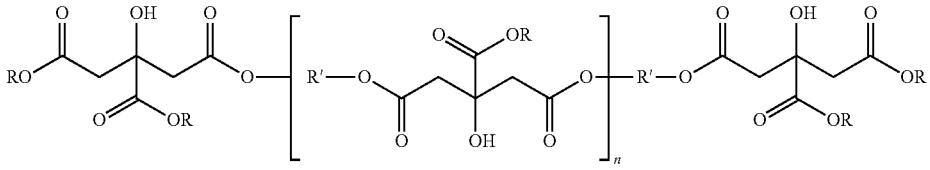

, or a mixture of citrate compounds of formula II and formula III, wherein:

n is from 1 to 20, e.g., 1 to 10, 1 to 5, or 1 to 3;

R is $C_{1-18}$ alkyl, $C_{1-12}$ alkyl or $C_{1-6}$ alkyl;

$C_{1-18}$ alkyl, $C_{1-12}$ alkyl or $C_{1-6}$ alkyl substituted by a carbocycle comprising 5 to 12 carbon atoms or a heterocycle comprising 3 to 11 carbon atoms and one or more heteroatoms selected from O, S and N, wherein the carbocycle or the heterocycle may be substituted by one or more $C_{1-12}$ alkyl or alkyloxy;

$C_{2-18}$ alkyl, $C_{2-12}$ alkyl or $C_{2-6}$ alkyl interrupted by one or more —O—, carbonyl, carbonyloxy and/or substituted by OH;

$C_{2-18}$ alkyl, $C_{2-12}$ alkyl or $C_{2-6}$ alkyl interrupted by one or more —O—, carbonyl or carbonyloxy and substituted by a carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or a carbocycle comprising 5 to 12 carbon atoms, or a heterocycle comprising 3 to 11, or 3 to 8, carbon atoms and one or more heteroatoms selected from O, S and N, wherein the carbocycle or heterocycle may be substituted by $C_{1-12}$ or $C_{1-8}$ alkyl or alkyloxy; and R' is $C_{2-18}$ alkylene, $C_{2-12}$ alkylene or $C_{2-8}$ alkylene;

$C_{2-18}$ alkylene, $C_{2-12}$ alkylene or $C_{2-8}$ alkylene interrupted by one or more —O—, carbonyl or carbonyloxy and/or substituted by OH, carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or said alkylene, interrupted alkylene or substituted alkylene interrupted by a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ or $C_{1-8}$ alkyl or alkyloxy;

wherein each R and each R' may be the same or different from any other R or R'; and (b) a fatty acid alkanolamide of formula IV

IV

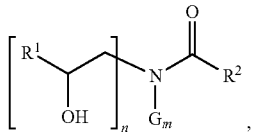

, wherein n is 1 or 2; when n is 1, m is 1; when n is 2, m is 0, $R^1$ is H or $C_{1-12}$ alkyl (such as $C_{1-8}$ alkyl or $C_{1-4}$ alkyl, e.g., methyl or ethyl), G is H or $C_{1-6}$ alkyl, and $R^2$ is selected from $C_{7-23}$ alkyl or alkenyl (e.g., $C_{7-19}$ alkyl or alkenyl, or $C_{9-19}$ alkyl or alkenyl).

Often, the ratio by weight of the citrate component (a) to the fatty acid alkanolamide component (b) is from 8:1 to 1:8, such as from 6:1 to 1:6, from 5:1 to 1:5, from 4:1 to 1:4, from 3.5:1 to 1:3.5, from 3:1 to 1:3, from 2:1 to 1:2, from 1.5:1 to 1:1.5, or about 1:1.

In many embodiments, the antiwear additive composition comprises more than one citrate compound of formula III which differ by having different values of n.

In many embodiments, the citrate component (a) of the antiwear composition further comprises a citrate compound of formula I

I

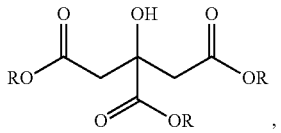

wherein R is as described above.

In further embodiments, the antiwear additive composition comprises at least one citrate compound of formula I, at least one citrate compound of formula II, and at least one citrate compound of formula III, wherein n is from 1 to 5, R is $C_{1-12}$ alkyl or $C_{2-12}$ alkyl interrupted by one or more —O—, and R' is $C_{2-12}$ alkylene, or said alkylene interrupted by one or more —O—.

In still other embodiments of the present disclosure, the antiwear additive composition comprises:

(a) a citrate compound of formula I

I

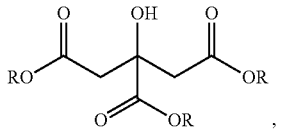

wherein R is a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy;

$C_{1-6}$ alkyl substituted by a carbocycle comprising 5 to 12 carbon atoms or a heterocycle comprising 3 to 11 carbon atoms and one or more heteroatoms selected from O, S and N, wherein the carbocycle or the heterocycle may be substituted by one or more $C_{1-12}$ alkyl or alkyloxy;

$C_{6-18}$ alkyl interrupted by one or more —O—, carbonyl, or carbonyloxy and/or substituted by OH; or $C_{6-18}$ alkyl interrupted by one or more —O—, carbonyl, or carbonyloxy and substituted by OH, carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; and (b) a fatty acid alkanolamide of formula IV as described above.

Often, the ratio by weight of the citrate component (a) to the fatty acid alkanolamide component (b) is from 8:1 to 1:8, such as from 6:1 to 1:6, from 5:1 to 1:5, from 4:1 to 1:4, from 3.5:1 to 1:3.5, from 3:1 to 1:3, from 2:1 to 1:2, from 1.5:1 to 1:1.5, or about 1:1.

For example, R in the citrate compound of formula I may be tris benzyl, tris norbornane methyl, trisadamantyl, tris tetrahydrofurfuryl, or tris triethylene glycol mono-methyl ether esters of citric acid, and the like. Such compounds of formula I may be used with or without other citrates.

Alkyl as described above may be linear alkyl or branched alkyl, and alkylene may be linear alkylene or branched alkylene. Alkylene refers to a hydrocarbon based chain or group connected to two other groups, also known as an alkyl-diyl. Carbocycle and heterocycle may be aromatic or non-aromatic, monocyclic or polycyclic. Alkyl or alkylene interrupted by —O— may be an ether, for example, R may be as shown in parentheses:

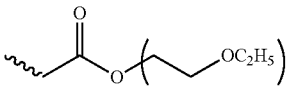

or polyether, for example, R' may be as shown in parentheses:

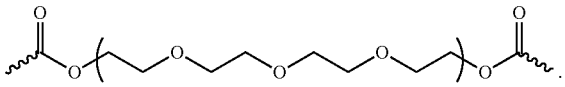

In some exemplary embodiments:

R is ethyl, propyl, butyl, pentyl, hexyl, heptyl, octyl, benzyl, norbornane methyl, adamantyl, tetrahydrofurfuryl, triethylene glycol mono-methyl ether, and isomers thereof, such as, isopropyl isobutyl, sec-butyl, tert-butyl, iso-pentyl, tert-pentyl, 2-ethylhexyl, and the like; and R' is ethane diyl; propane 1,2- or 1,3-diyl; butane 1,4-, 1,2 or 1,3 diyl; pentane 1,5 or 1,4 diyl; hexane 1,6-diyl; 2-ethyl hexane 1,6-diyl; and the like.

Citrate compounds of formulas I, II and III may be prepared according to the methods described in International Patent Publication No. WO 2019/157350. For example, citrates of formula I can be prepared by any known esterification process. In one embodiment, citrates of formulas II and III may be prepared by reacting citric acid with a polyol, such as a diol, often in the presence of an acid catalyst, such as methane sulfonic acid, to obtain a dimer, trimer, various other oligomers, etc., depending on the relative amounts of citric acid and polyol used, followed by standard esterification of the remaining carboxylic acid groups, e.g., reaction with a monohydric alcohol in the presence of an acid, i.e., a two-step method. In an alternate method, citric acid may be reacted with an alcohol, such as butanol, and a diol, such as 1,6-hexanediol, together, in the presence of a catalyst, e.g., an acid catalyst, at the same time in the same vessel, i.e., a one-step method.

Often, depending on the process for the preparation of compounds of formula III, a mixture of compounds of formula III differing in the value for n will be present in varying amounts. For example, when preparing predominately a trimer, i.e., a compound of formula III wherein n=1, it is common for dimers, monomeric compounds, tetramers and pentamers to also be present. Similarly, when preparing predominately compounds of formula II, it is common for monomeric compounds and compounds of formula III to also be present. In some embodiments, mixtures of such compounds are desirable, as mixtures may exhibit a higher degree of solubility than a single component.

Many embodiments of the present disclosure make use of the above one step or two step method to generate mixtures of citrate compounds comprising varying amounts of compounds of formula II and formula III having different values for n. Often, these mixtures will also contain compounds of formula I. By varying conditions, one can increase the amount of a desired component, and, if desired, it is possible to separate the mixtures using standard techniques.

Exemplary citrate compounds used according to the present disclosure include, but are not limited to, tris(tetrahydrofurfuryl) citrate, ethyl-tetrahydrofurfuryl citrate, tris(1-adamantyl) citrate, tris(2-adamantyl) citrate, tris(2-norbornanemethyl)citrate, tris(triethylene glycol monomethyl ether) citrate, and tribenzyl citrate.

In many embodiments, the citrate compounds used according to the present disclosure are chosen from bis dialkyl citrate diol linked oligomers, such as where the alkyl is $C_{2-12}$ alkyl, $C_{2-8}$ alkyl, or $C_{2-6}$ alkyl, (e.g., ethyl, propyl, butyl, pentyl, hexyl, heptyl or octyl), and the diol linker(s) is/are ethane diol, propane 1,2 or 1,3 diol, butane 1,4, 1,2 or 1,3 diol, pentane 1,5 or 1,4 diol, hexane 1,6 diol, or 2-ethyl hexane 1,6 diol. For example, the citrate compounds may be chosen from bis dihexyl citrate diol linked oligomers, e.g., oligomers of bis dihexyl citrate linked by ethane-1,2 diol, propane-1,2 diol, or butane-1,4 diol linkers.

The fatty acid alkanolamide of the present disclosure is a compound of formula IV:

IV

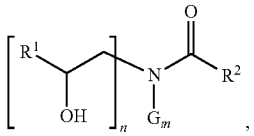

wherein n is 1 or 2; when n is 1, m is 1; when n is 2, m is 0, $R^1$ is H or $C_{1-12}$ alkyl (such as $C_{1-8}$ alkyl or $C_{1-4}$ alkyl, e.g., methyl or ethyl).

G is H or $C_{1-6}$ alkyl, and $R^2$ is selected from $C_{7-23}$ alkyl or alkenyl (e.g., $C_{7-19}$ alkyl or alkenyl, or $C_{9-19}$ alkyl or alkenyl).

In further embodiments, the fatty acid alkanolamide of formula IV is a compound of formula V:

V

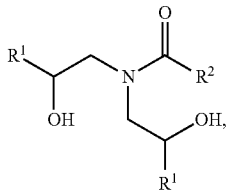

wherein $R^1$ is H or $C_{1-12}$ alkyl (such as $C_{1-8}$ alkyl or $C_{1-4}$ alkyl, e.g., methyl or ethyl), and $R^2$ is selected from $C_{7-23}$ alkyl or alkenyl (e.g., $C_{7-19}$ alkyl or alkenyl, or $C_{9-19}$ alkyl or alkenyl).

The fatty acid alkanolamides of the present disclosure may be prepared by known methods, e.g., reaction between an alkanol amine and a carboxylic acid or carboxylic acid derivative e.g., an ester, acid chloride, etc. Mixtures of compounds may be conveniently prepared by using more than one alkanol amine and/or more than one carboxylic acid or carboxylic acid derivative during the reaction, although one may prepare individual amides and blend them.

In some embodiments, the fatty acid alkanolamide is a compound of formula IV or V wherein $R^1$ is selected from $C_{1-12}$ alkyl, such as $C_{1-8}$ alkyl or $C_{1-4}$ alkyl, e.g., methyl or ethyl. Exemplary fatty acid alkanolamides of formulas IV and V, and methods of preparing the same, are found in U.S. Pat. No. 9,562,207, which is incorporated herein by reference for this purpose. $C_{1-12}$ alkyl and $C_{1-6}$ alkyl (such as $C_{1-8}$ alkyl or $C_{1-4}$ alkyl) represent a straight or branched fully saturated chain of the designated number of carbon atoms, e.g., methyl, ethyl, propyl, isopropyl, butyl, sec-butyl, iso-butyl, tert-butyl, pentyl, sec-pentyl, tert-pentyl, hexyl, methylpentyl, ethyl butyl, etc.

$C_{7-23}$ alkyl or alkenyl (e.g., $C_{7-19}$ alkyl or alkenyl, or $C_{9-19}$ alkyl or alkenyl) represents a straight or branched chain of the designated number of carbon atoms, which is fully saturated in the case of alkyl or contains one or more carbon-carbon double bonds in the case of alkenyl.

The two $R^1$ groups in formula V may be the same or different. For example, each $R^1$ may be independently selected from H, methyl, ethyl, propyl, iso-propyl, butyl, sec-butyl, iso-butyl and tert-butyl. In some embodiments $R^1$ is methyl or ethyl. In certain embodiments, each $R^1$ is methyl.

In many embodiments, the fatty acid alkanolamide is a mixture of compounds. For example, in many embodiments, a mixture of compounds of formula IV or formula V differing at $R^2$ is employed. In such mixtures, for example, at least one compound of formula IV or V where $R^2$ is $C_{15}$ alkyl or alkenyl and at least one compound of formula IV or V where $R^2$ is $C_{17}$ alkyl or alkenyl may be present. In some embodiments, the majority of $R^2$ groups in the mixture are selected from $C_{13}$, $C_{15}$ and $C_{17}$ alkyl or alkenyl (which correlate with products derived from $C_{14}$, $C_{16}$ and $C_{18}$ fatty acids), for example, in some embodiments, the majority of $R^2$ groups in the mixture are $C_{15}$ and/or $C_{17}$ alkyl or alkenyl. In many embodiments, both alkyl and alkenyl groups are present at $R^2$ in the amide mixtures.

There are variety of natural sources for the carboxylic acid or derivative used in the preparation of the alkanolamides, e.g., fats and oils, such as canola oil, corn oil, coconut oil, sunflower oil, soybean oil, lard, palm oil, beef tallow, cocoa butter, illipe, which provide mixtures of carboxylic acids and derivatives. The carboxylic acids or carboxylic acid derivatives may be reacted with a di(hydroxyalkyl) amine. U.S. Pat. No. 9,562,207 has shown particular value in preparing fatty acid alkanolamides from bis(2-hydroxypropyl)amine and methyl esters derived from beef tallow carboxylates.

The carboxylate groups of fats and oils are often present as esters. For example, beef tallow contains esters, such as glycerides, diglycerides, triglycerides etc., of palmitic acid (saturated $C_{16}$ acid), stearic acid (saturated $C_{18}$ acid), oleic acid(mono-unsaturated $C_{18}$ acid) and smaller amounts of poly-unsaturated $C_{18}$ acids and other fatty acids. Thus, using beef tallow as the source of the alkylcarboxy portion of the alkanolamides provides a mixture of predominately palmitic, stearyl and oleic amides, i.e., compounds of formula V wherein $R^2$ is $C_{15}$ alkyl, $C_{17}$ alkyl and $C_{17}$ alkenyl.

It is possible to use the natural source as it is obtained, for example, a mixture of glycerides, or the natural mixture of products can be hydrolyzed to a fatty acid mixture or otherwise transformed, e.g., transesterified with a smaller alcohol, prior to use. For example, a tallow triglyceride can be reacted with methanol to provide a mixture of methyl tallowate esters which can be reacted with the desired amine; the tallow triglyceride can be hydrolyzed to a tallow acid mixture and then reacted with the amine; or the triglyceride can be directly reacted with amine. Each of these methods can be used to prepare the same or similar amide mixture, however, processing conditions and side products may vary.

In some embodiments, the fatty acid alkanolamide is a mixture of compounds of formula IV or V wherein about 15 to about 45% by weight of the alkanolamides are compounds where $R^2$ is $C_{15}$ alkyl or alkenyl, about 40 to about 80% by weight of the alkanolamides are compounds where $R^2$ is $C_{17}$ alkyl or alkenyl, and 0 or 0.1 to about 15%, or 2 to 15%, by weight of the alkanolamides are compounds where $R^2$ is $C_{7-14}$, $C_{16}$ or $C_{18-19}$ alkyl or alkenyl;

for example, wherein about 20 to about 35% by weight of the alkanolamides are compounds where $R^2$ is $C_{15}$ alkyl or alkenyl, about 50 to about 75% by weight of the alkanolamides are compounds where $R^2$ is $C_{17}$ alkyl or alkenyl, and 0 to about 15%, or 2 to 15%, by weight of the alkanolamides are compounds where $R^2$ is $C_{7-14}$, $C_{16}$ or $C_{18-19}$ alkyl or alkenyl, in some embodiments, 0 or 2 to about 15% by weight of the alkanolamides are compounds where $R^2$ is $C_{9-14}$, $C_{16}$ or $C_{18-19}$ alkyl or alkenyl.

In some embodiments, about 30 to about 70% by weight of the alkanolamides are compounds where $R^2$ is $C_{7-19}$ alkyl and about 30 to about 70% by weight are compounds where $R^2$ is $C_{7-19}$ alkenyl.

In some embodiments, the fatty acid alkanolamide is a mixture of compounds of formula IV or V wherein about 15 to about 45%, for example, about 20 to about 35%, by weight of the alkanolamides are compounds where $R^2$ is $C_{15}$ alkyl or alkenyl wherein a majority, for example, about 75% or more, 90% or more, or 95% or more of the $C_{15}$ alkyl or alkenyl are alkyl;

about 40 to about 80%, for example, about 50 to about 75%, by weight of the alkanolamides are compounds where $R^2$ is $C_{17}$ alkyl or alkenyl, wherein about 40 to about 95% of said $C_{17}$ alkyl or alkenyl are alkenyl; and 0 or 1 to about 15% by weight of the alkanolamides are compounds where $R^2$ is $C_{7-14}$, $C_{16}$ or $C_{18-19}$ alkyl or alkenyl, for example, $C_{9-14}$, $C_{16}$ or $C_{18-19}$ alkyl or alkenyl.

In some embodiments, about 15 to about 45% of the alkanolamides are compounds wherein $R^2$ is fully saturated $C_{15}$ alkyl, and a portion of the alkanolamides are compounds where $R^2$ as $C_{17}$ are saturated alkyl and a portion are alkenyl. In some embodiments, about 20 to about 35% by weight of the alkanolamides are compounds wherein $R^2$ is fully saturated $C_{15}$ alkyl and both $C_{17}$ alkyl and $C_{17}$ alkenyl as $R^2$ are present.

In some embodiments, the antiwear additive composition of the present disclosure consists essentially of the citrate component (a) and the fatty acid alkanolamide component (b), as described herein, as active agents. In some embodiments, the antiwear additive composition is fully organic. In some embodiments, the antiwear additive composition is free of metals. In further embodiments, the antiwear additive composition is free of metals, phosphorus and sulfur. In other embodiments, the antiwear additive composition further comprises ZDDP. In further embodiments, the antiwear additive composition consists essentially of the citrate component (a), the fatty acid alkanolamide component (b) and ZDDP as active agents. In many embodiments, the ratio by weight of the citrate component (a) to ZDDP is from 4:1 to 1:4, such as from 3:1 to 1:3, from 2:1 to 1:2, from 1.5:1 to 1:1.5, from 2:1 to 1:1 or from 1:1 to 1:2.

In a further aspect, the present disclosure is directed to a lubricant composition comprising A) a lubricating oil, B) from 0.1 to 5 wt %, e.g., from 0.15 to 4 wt %, from 0.2 to 3 wt %, from 0.25% to 2.5 wt %, from 0.3% to 2.0 wt %, from 0.4% to 1.5%, from 0.45% to 1.25%, or from 0.5% to 1.0%, based on the weight of the lubricant composition, of one or more citrate compounds of formula I, formula II, formula III or mixtures thereof, as described above, and C) from 0.1 to 5 wt %, e.g., from 0.15 to 4 wt %, from 0.2 to 3 wt %, from 0.25% to 2.5 wt %, from 0.3% to 2.0 wt %, from 0.4% to 1.5%, from 0.45% to 1.25%, or from 0.5% to 1.0%, based on the weight of the lubricant composition, of a fatty acid alkanolamide of formula IV as described herein. Often, the ratio by weight of the citrate component B) to the fatty acid alkanolamide component C) is from 8:1 to 1:8, such as from 6:1 to 1:6, from 5:1 to 1:5, from 4:1 to 1:4, from 3.5:1 to 1:3.5, from 3:1 to 1:3, from 2:1 to 1:2, from 1.5:1 to 1:1.5, or about 1:1.

In many embodiments, the lubricant composition comprises:

A) a lubricating oil,

B) from 0.1 to 5 wt %, e.g., as described above, based on the weight of the lubricant composition, of a citrate compound of formula II above, or a citrate compound of formula III above, or a mixture of citrate compounds of formula II and formula III, wherein n, R and R' are as described above; and C) from 0.1 to 5 wt %, e.g., as described above, based on the weight of the lubricant composition, of a fatty acid alkanolamide of formula IV as described above.

In many embodiments, the ratio by weight of the citrate component B) to the fatty acid alkanolamide component C) is from 8:1 to 1:8, such as described above.

In many embodiments, the lubricant composition further comprises a citrate compound of formula I as above, wherein R is as described above, and the wt % of all citrate compounds of formulas I, II and III combined is from 0.1 to 5 wt %, e.g., from 0.15 to 4 wt %, from 0.2 to 3 wt %, from 0.25% to 2.5 wt %, from 0.3% to 2.0 wt %, from 0.4% to 1.5%, from 0.45% to 1.25%, or from 0.5% to 1.0%, based on the weight of the lubricant composition.

In further embodiments, the lubricant composition comprises at least one citrate compound of formula I, at least one citrate compound of formula II, and at least one citrate compound of formula III, wherein n is from 1 to 5, R is $C_{1-12}$ alkyl or $C_{2-12}$ alkyl interrupted by one or more —O—, and R' is $C_{2-12}$ alkylene, or said alkylene interrupted by one or more —O—.

In still other embodiments, the lubricant composition comprises:

A) a lubricating oil,

B) from 0.1 to 5 wt %, e.g., from 0.15 to 4 wt %, from 0.2 to 3 wt %, from 0.25% to 2.5 wt %, from 0.3% to 2.0 wt %, from 0.4% to 1.5%, from 0.45% to 1.25%, or from 0.5% to 1.0%, based on the weight of the lubricant composition, of a citrate compound of formula I as above, wherein R is a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy;

$C_{1-6}$ alkyl substituted by a carbocycle comprising 5 to 12 carbon atoms or a heterocycle comprising 3 to 11 carbon atoms and one or more heteroatoms selected from O, S and N, wherein the carbocycle or the heterocycle may be substituted by one or more $C_{1-12}$ alkyl or alkyloxy;

$C_{6-18}$ alkyl interrupted by one or more —O—, carbonyl, or carbonyloxy and/or substituted by OH; or $C_{6-18}$ alkyl interrupted by one or more —O—, carbonyl, or carbonyloxy and substituted by OH, carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; and C) from 0.1 to 5 wt %, e.g., from 0.15 to 4 wt %, from 0.2 to 3 wt %, from 0.25% to 2.5 wt %, from 0.3% to 2.0 wt %, from 0.4% to 1.5%, from 0.45% to 1.25%, or from 0.5% to 1.0%, based on the weight of the lubricant composition, of a fatty acid alkanolamide of formula IV as described above.

Often, the ratio by weight of the citrate component B) to the fatty acid alkanolamide component C) is from 8:1 to 1:8, such as from 6:1 to 1:6, from 5:1 to 1:5, from 4:1 to 1:4, from 3.5:1 to 1:3.5, from 3:1 to 1:3, from 2:1 to 1:2, from 1.5:1 to 1:1.5, or about 1:1.

For example, R in the citrate compound of formula I may be tris benzyl, tris norbornane methyl, trisadamantyl, tris tetrahydrofurfuryl, or tris triethylene glycol mono-methyl ether esters of citric acid, and the like. Such compounds of formula I may be used with or without other citrates.

In further embodiments, a lubricant composition comprises the lubricating oil component A), the citrate component B), and the fatty acid alkanolamide component C), as described above, and further comprises ZDDP as component D). In many embodiments, ZDDP is present at from 0.1 to 2.5 wt %, e.g., from 0.1 to 2 wt %, from 0.1 to 1.5 wt %, from 0.5 to 2 wt %, from 0.5 to 1.5 wt % or from 0.5 to 1 wt %, based on the weight of the lubricant composition. Often, the ratio by weight of the citrate component B) to the ZDDP component D) is from 4:1 to 1:4, such as from 3:1 to 1:3, from 2:1 to 1:2, from 1.5:1 to 1:1.5, from 2:1 to 1:1 or from 1:1 to 1:2.

Lubricant compositions typically contain a variety of other additives, for example, dispersants, detergents, corrosion/rust inhibitors, antioxidants, anti-wear agents, anti-foamants, friction modifiers, seal swell agents, demulsifiers, V.I. improvers, pour point depressants, and the like. A sampling of these additives can be found in, for example, U.S. Pat. Nos. 5,498,809 and 7,696,136, the relevant portions of each disclosure are incorporated herein by reference, although the practitioner is well aware that this comprises only a partial list of available lubricant additives. It is also well known that one additive may be capable of providing or improving more than one property, e.g., an anti-wear agent may also function as an anti-fatigue and/or an extreme pressure additive.

The lubricant compositions of the present disclosure will often contain any number of these additives. Thus, the lubricant compositions will generally contain a combination of additives along with the inventive combination of the citrate component and fatty acid alkanolamide component of the present disclosure, optionally further combined with ZDDP. The total combined additives may range, for example, from about 0.5 to about 30 weight percent, e.g., from about 0.5 to about 20, to about 15, or to about 10 weight percent, based on the total weight of the lubricant composition. For example, the combined additives may be present from about 1 to about 5 or to about 10 weight percent. Oil concentrates of the additives may contain, e.g., from about 30 to about 75 weight percent additives.

Given the ubiquitous presence of additives in a lubricant formulation, the amount of lubricating oil present in the inventive lubricant composition is not specified above, but in most embodiments, except additive concentrates, the lubricating oil is a majority component, i.e., present in more than 50 wt % based on the weight of the composition, for example, 60 wt % or more, 70 wt % or more, 80 wt % or more, 90 wt % or more, or 95 wt % or more.

The lubricating oil may be any lubricating oil of lubricating viscosity. For example, a lubricating oil base stock is any natural or synthetic lubricating oil base stock fraction having a kinematic viscosity at 100° C. of about 2 to about 200 cSt, about 3 to about 150 cSt, and often about 3 to about 100 cSt. The lubricating oil base stock can be derived from natural lubricating oils, synthetic lubricating oils, or mixtures thereof. Suitable lubricating oil base stocks include, for example, petroleum oils, mineral oils, and oils derived from coal or shale petroleum based oils, animal oils, such as lard oil, vegetable oils (e.g., canola oils, castor oils, sunflower oils) and synthetic oils.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from monocarboxylic acids or diacids and polyols and polyol ethers. Other esters useful as synthetic oils include those made from copolymers of alphaolefins and dicarboxylic acids which are esterified with short or medium chain length alcohols.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly alphaolefins, and the like.

The lubricating oil may be derived from unrefined, refined, re-refined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the waxes produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a V.I. of at least 130, preferably at least 135 or higher and, following dewaxing, a pour point of about −20° C. or lower.

The organic citrate and fatty acid alkanolamide additives of the present disclosure can be added to the lubricating oil directly as a combination or as individual components. These additives each, or their mixture, can be added by itself or along with other common additives (e.g., as part of an additive package). A concentrate containing these additives may also be prepared and added to the lubricating oil. It is also possible to add the citrate and fatty acid alkanolamide components to a preformulated lubricating oil which already contains all or most of the other formulation components. For example, a preformulated lubricating oil containing many or all of the other formulation components may be top treated with the citrate and fatty acid alkanolamide additives of the present disclosure, or top treated with either of the two if the formulation already contains the other.

The lubricant compositions of the present disclosure can be used in a variety of applications, for example, crankcase lubricating oils for spark-ignited and compression-ignited internal combustion engines, gas engine lubricants, turbine lubricants, automatic transmission fluids, gear lubricants, compressor lubricants, metal-working lubricants, hydraulic fluids, shock absorbing fluids, and other lubricating oil and grease compositions.

Further non-limiting disclosure is provided in the Examples that follow.

EXAMPLES

Example 1

Citrate Component (Citrate-1):

Propane-1,2-diyl bis(dihexyl citrate) oligomers prepared by the reaction of citric acid, hexanol and 1,2-propanediol in the presence of an acid catalyst.

Fatty Acid Alkanolamide:

Additin® RC 3502 from LANXESS, which is a bis(2-hydoxypropyl) tallowamide.

Zinc Dialkyldithiophosphate (ZDDP).

Lubricating Oil:

5W-30 oil (fully formulated, but without any antiwear or friction modifier additives, "STD").

Lubricant compositions containing the reference 5W-30 oil (STD) and the weight percentages of the additives shown in Table 1a were prepared and tested for anti-wear performance using ASTM D4172 four-ball wear testing where three steel hardened balls were placed in contact with the test fluid under 40 kg load and a fourth ball was rotated at 1200 rpm for 1 hour while the test sample was heated at 75° C. After the test, the wear scar diameter of each of the three captured stationary balls was measured in two perpendicular directions and the average wear scar (in mm) was reported.

TABLE 1a

| Inv/ Comp | Sample | Wear (mm) |
|---|---|---|
| Comp. | STD | 0.774 |
| Comp. | STD + ZDDP (1 wt %) | 0.453 |
| Comp. | STD + Citrate-1 (1 wt %) | 0.406 |
| Comp. | STD + RC 3502 (1 wt %) | 0.445 |
| Inv. | STD + Citrate-1 (0.5 wt %) + RC 3502 (0.5 wt %) | 0.353 |

The results demonstrate a synergistic effect on antiwear performance of the combination of the citrate component with the alkanolamide component. That is, the antiwear activity of the combination was significantly enhanced relative to the activity of the citrate and fatty acid alkanolamide when each was tested alone, all at the same total load level.

Moreover, further enhancement in antiwear activity was exhibited by the three-way combination of the citrate, the fatty acid alkanolamide and ZDDP, as shown in Table 1b. The present invention therefore allows one to obtain excellent antiwear properties with a fully organic antiwear additive composition, and, if combined with ZDDP, achieves further enhanced antiwear performance, while at the same time allowing for reduced levels of the amount of ZDDP in the lubricant formulation.

TABLE 1b

| Inv/ Comp | Sample | Wear (mm) |
|---|---|---|
| Comp. | STD + Citrate-1 (0.5 wt %) + ZDDP (0.5 wt %) | 0.307 |
| Inv. | STD + Citrate-1 (0.5 wt %) + RC 3502 (1 wt %) + ZDDP (0.5 wt %) | 0.27 |

Similar results are shown in the further Examples below.

Example 2

Lubricant compositions were prepared and tested according to Example 1, except the citrate component (Citrate-2) was butane-1,4-diyl bis(dihexyl citrate) oligomers prepared by the reaction of citric acid, hexanol and 1,4-butanediol in the presence of an acid catalyst. The samples and results are shown in Tables 2a and 2b.

TABLE 2a

| Inv/ Comp | Sample | Wear (mm) |
|---|---|---|
| Comp. | STD | 0.743 |
| Comp. | STD + ZDDP (1 wt %) | 0.448 |
| Comp. | STD + Citrate-2 (1 wt %) | 0.396 |
| Comp. | STD + RC 3502 (1 wt %) | 0.445 |
| Inv. | STD + Citrate-2 (0.5 wt %) + RC 3502 (0.5 wt %) | 0.357 |

TABLE 2b

| Inv/ Comp | Sample | Wear (mm) |
|---|---|---|
| Comp. | STD + Citrate-2 (0.5 wt %) + ZDDP (0.5 wt %) | 0.32 |
| Inv. | STD + Citrate-2 (0.5 wt %) + RC 3502 (1 wt %) + ZDDP (0.5 wt %) | 0.308 |

Example 3

Lubricant compositions were prepared and tested according to Example 1, except the citrate component (Citrate-3)

was hexane-1,6-diyl bis(dihexyl citrate) oligomers prepared by the reaction of citric acid, hexanol and 1,6-hexanediol in the presence of an acid catalyst. The samples and results are shown in Tables 3a and 3b.

TABLE 3a

| Inv/ Comp | Sample | Wear (mm) |
|---|---|---|
| Comp. | STD | 0.743 |
| Comp. | STD + ZDDP (1 wt %) | 0.448 |
| Comp. | STD + Citrate-3 (1 wt %) | 0.408 |
| Comp. | STD + RC 3502 (1 wt %) | 0.445 |
| Inv. | STD + Citrate-3 (0.5 wt %) + RC 3502 (0.5 wt %) | 0.340 |

TABLE 3b

| Inv/ Comp | Sample | Wear (mm) |
|---|---|---|
| Comp. | STD + Citrate-3 (0.5 wt %) + ZDDP (0.5 wt %) | 0.332 |
| Inv. | STD + Citrate-3 (0.5 wt %) + RC 3502 (1 wt %) + ZDDP (0.5 wt %) | 0.306 |

Example 4

Lubricant compositions were prepared and tested according to Example 1, except the citrate component (Citrate-4) was ethane-1,2-diyl bis(dihexyl citrate) oligomers prepared by the reaction of citric acid, hexanol and 1,2-ethanediol in the presence of an acid catalyst. The samples and results are shown in Tables 4a and 4b.

TABLE 4a

| Inv/ Comp | Sample | Wear (mm) |
|---|---|---|
| Comp. | STD | 0.743 |
| Comp. | STD + ZDDP (1 wt %) | 0.453 |
| Comp. | STD + Citrate-4 (1 wt %) | 0.426 |
| Comp. | STD + RC 3502 (1 wt %) | 0.445 |
| Inv. | STD + Citrate-4 (0.5 wt %) + RC 3502 (0.5 wt %) | 0.412 |

TABLE 4b

| Inv/ Comp | Sample | Wear (mm) |
|---|---|---|
| Comp. | STD + Citrate-4 (0.5 wt %) + ZDDP (0.5 wt %) | 0.316 |
| Inv. | STD + Citrate-4 (0.5 wt %) + RC 3502 (1 wt %) + ZDDP (0.5 wt %) | 0.292 |

Although particular embodiments of the present invention have been illustrated and described, this description is not meant to be construed in a limiting sense. Various changes and modifications may be made without departing from the principle and scope of the present invention, which is defined by the appended claims.

What is claimed is:

1. An antiwear additive composition comprising:

(a) a citrate compound of formula II

II

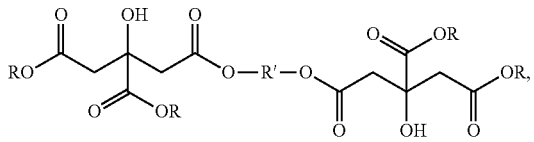

or a citrate compound of formula III

III

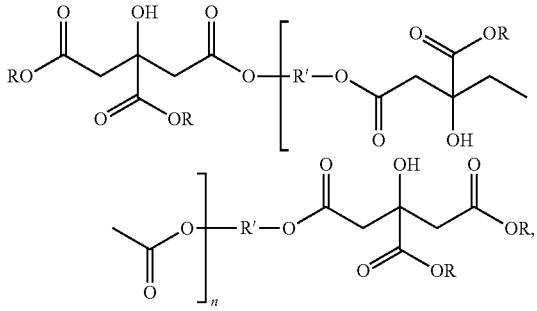

or a mixture of citrate compounds of formula II and formula III, wherein:

n is from 1 to 20;

R is $C_{1-18}$ alkyl;

$C_{1-18}$ alkyl substituted by a carbocycle comprising 5 to 12 carbon atoms or a heterocycle comprising 3 to 11 carbon atoms and one or more heteroatoms selected from O, S and N, wherein the carbocycle or the heterocycle may be substituted by one or more $C_{1-12}$ alkyl or alkyloxy;

$C_{2-18}$ alkyl interrupted by one or more —O—, carbonyl, carbonyloxy and/or substituted by OH;

$C_{2-18}$ alkyl interrupted by one or more —O—, carbonyl or carbonyloxy and substituted by a carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy; and R' is $C_{2-18}$ alkylene;

$C_{2-18}$ alkylene interrupted by one or more —O—, carbonyl or carbonyloxy and/or substituted by OH, carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or said alkylene, interrupted alkylene or substituted alkylene interrupted by a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy;

wherein each R and each R' may be the same or different from any other R or R'; and (b) a fatty acid alkanolamide of formula IV

IV

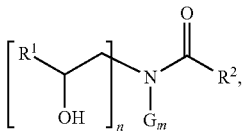

wherein n is 1 or 2; when n is 1, m is 1; when n is 2, m is 0, $R^1$ is H or $C_{1-12}$ alkyl, G is H or $C_{1-6}$ alkyl, and $R^2$ is selected from $C_{7-23}$ alkyl or alkenyl;

wherein the ratio by weight of the citrate component (a) to the fatty acid alkanolamide component (b) is from 8:1 to 1:8.

2. The antiwear additive composition according to claim 1, wherein the composition comprises more than one citrate compound of formula III which differ by having different values of n.

3. The antiwear additive composition according to claim 1, wherein component (a) further comprises a citrate compound of formula I

I

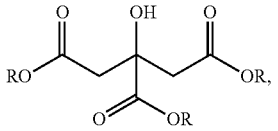

wherein R is as described for formula II and III.

4. The antiwear additive composition according to claim 3, wherein the additive composition comprises at least one citrate compound of formula I, at least one citrate compound of formula II, and at least one citrate compound of formula III, wherein n is from 1 to 5; R is $C_{1-12}$ alkyl or $C_{2-12}$ alkyl interrupted by one or more —O—, and R' is $C_{2-12}$ alkylene, or said alkylene interrupted by one or more —O—.

5. An antiwear additive composition comprising:

(a) a citrate compound of formula I

I

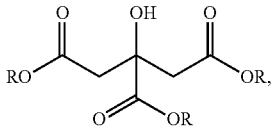

wherein R is a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy;

$C_{1-6}$ alkyl substituted by a carbocycle comprising 5 to 12 carbon atoms or a heterocycle comprising 3 to 11 carbon atoms and one or more heteroatoms selected from O, S and N, wherein the carbocycle or the heterocycle may be substituted by one or more $C_{1-12}$ alkyl or alkyloxy;

$C_{6-18}$ alkyl interrupted by one or more —O—, carbonyl, or carbonyloxy and/or substituted by OH; or $C_{6-18}$ alkyl interrupted by one or more —O—, carbonyl, or carbonyloxy and substituted by OH, carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; and (b) a fatty acid alkanolamide of formula IV

IV

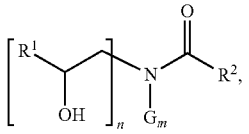

wherein n is 1 or 2; when n is 1, m is 1; when n is 2, m is 0, $R^1$ is H or $C_{1-12}$ alkyl, G is H or $C_{1-6}$ alkyl, and $R^2$ is selected from $C_{7-23}$ alkyl or alkenyl;

wherein the ratio by weight of the citrate component (a) to the fatty acid alkanolamide component (b) is from 8:1 to 1:8.

6. The antiwear additive composition according to claim 1, wherein the fatty acid alkanolamide is a compound of formula V:

V

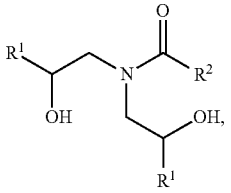

wherein $R^1$ is H or $C_{1-12}$ alkyl, and $R^2$ is selected from $C_{7-23}$ alkyl or alkenyl.

7. The antiwear additive composition according to claim 6, wherein $R^1$ is chosen from $C_{1-4}$ alkyl.

8. The antiwear additive composition according to claim 6, wherein the fatty acid alkanolamide is a mixture of compounds of formula V, wherein about 15 to about 45% by weight of the fatty acid alkanolamide are compounds where $R^2$ is $C_{15}$ alkyl or alkenyl, about 40 to about 80% by weight of the fatty acid alkanolamide are compounds where $R^2$ is $C_{17}$ alkyl or alkenyl, and 0 to about 15% by weight of the fatty acid alkanolamide are compounds where $R^2$ is $C_{7-14}$, $C_{16}$ of $C_{18-19}$ alkyl or alkenyl.

9. The antiwear additive composition according to claim 6, wherein the fatty acid alkanolamide is prepared by reacting a di(hydroxyalkyl) amine with carboxylic acids or carboxylic acid derivatives from canola oil, corn oil, coconut oil, sunflower oil, soybean oil, lard, palm oil, beef tallow, cocoa butter, or illipe.

10. A lubricant composition comprising:

A) a lubricating oil,

B) from 0.1 to 5 wt %, based on the weight of the lubricant composition, of a citrate compound of formula II

II

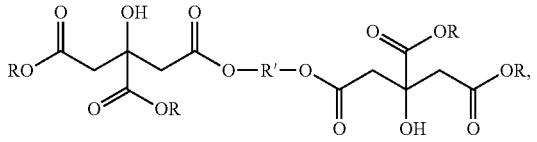

or a citrate compound of formula III

III

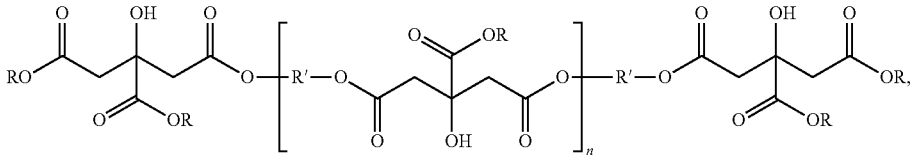

or a mixture of citrate compounds of formula II and formula III, wherein:

n is from 1 to 20;

R is $C_{1-18}$ alkyl;

$C_{1-18}$ alkyl substituted by a carbocycle comprising 5 to 12 carbon atoms or a heterocycle comprising 3 to 11 carbon atoms and one or more heteroatoms selected from O, S and N, wherein the carbocycle or the heterocycle may be substituted by one or more $C_{1-12}$ alkyl or alkyloxy;

$C_{2-18}$ alkyl interrupted by one or more —O—, carbonyl, carbonyloxy and/or substituted by OH;

$C_{2-18}$ alkyl interrupted by one or more —O—, carbonyl or carbonyloxy and substituted by a carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy; and R' is $C_{2-18}$ alkylene;

$C_{2-18}$ alkylene interrupted by one or more —O—, carbonyl or carbonyloxy and/or substituted by OH, carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or said alkylene, interrupted alkylene or substituted alkylene interrupted by a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy;

wherein each R and each R' may be the same or different from any other R or R'; and C) from 0.1 to 5 wt %, based on the weight of the lubricant composition, of a fatty acid alkanolamide of formula IV

IV

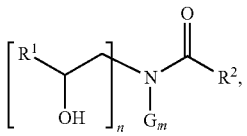

wherein n is 1 or 2; when n is 1, m is 1; when n is 2, m is 0,

R' is H or $C_{1-12}$ alkyl,

G is H or $C_{1-6}$ alkyl, and $R^2$ is selected from $C_{7-23}$ alkyl or alkenyl.

11. The lubricant composition according to claim 10, wherein the ratio by weight of the citrate component B) to the fatty acid alkanolamide component C) is from 8:1 to 1:8.

12. The lubricant composition according to claim 10, wherein the composition comprises more than one citrate compound of formula III which differ by having different values of n.

13. The lubricant composition according to claim 10, further comprising a citrate compound of formula I

I

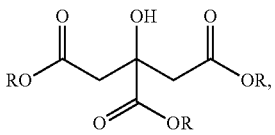

wherein R is as described for formula II and III, and the wt % of all citrate compounds of formulas I, II and III combined is from 0.1 to 5 wt %, based on the weight of the lubricant composition.

14. The lubricant composition according to claim 13, wherein the composition comprises at least one citrate compound of formula I, at least one citrate compound of formula II, and at least one citrate compound of formula III, wherein n is from 1 to 5; R is $C_{1-12}$ alkyl or $C_2$-12 alkyl interrupted by one or more —O—, and R' is $C_{2-12}$ alkylene, or said alkylene interrupted by one or more —O—.

15. A lubricant composition comprising:

A) a lubricating oil,

B) from 0.1 to 5 wt %, based on the weight of the lubricant composition, of a citrate compound of formula I

I

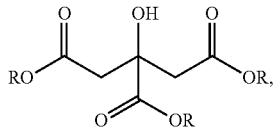

wherein R is a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy;

$C_{1-6}$ alkyl substituted by a carbocycle comprising 5 to 12 carbon atoms or a heterocycle comprising 3 to 11 carbon atoms and one or more heteroatoms selected from O, S and N, wherein the carbocycle or the heterocycle may be substituted by one or more $C_{1-12}$ alkyl or alkyloxy;

$C_{6-18}$ alkyl interrupted by one or more —O—, carbonyl, or carbonyloxy and/or substituted by OH; or $C_{6-18}$ alkyl interrupted by one or more —O—, carbonyl, or carbonyloxy and substituted by OH, carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; and C) from 0.1 to 5 wt %, based on the weight of the lubricant composition, of a fatty acid alkanolamide of formula IV

IV

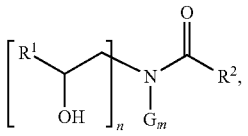

wherein n is 1 or 2; when n is 1, m is 1; when n is 2, m is 0, $R^1$ is H or $C_{1-12}$ alkyl, G is H or $C_{1-6}$ alkyl, and $R^2$ is selected from $C_{7-23}$ alkyl or alkenyl.

16. The lubricant composition according to claim 15, wherein the ratio by weight of the citrate component B) to the fatty acid alkanolamide component C) is from 8:1 to 1:8.

17. The lubricant composition according to claim 10, wherein the fatty acid alkanolamide is a compound of formula V:

V

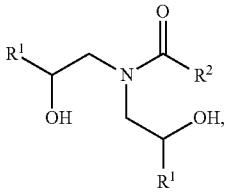

wherein $R^1$ is H or $C_{1-12}$ alkyl, and $R^2$ is selected from $C_{7-23}$ alkyl or alkenyl.

18. The lubricant composition according to claim 17, wherein $R^1$ is chosen from $C_{1-4}$ alkyl.

19. The lubricant composition according to claim 18, wherein $R^1$ is methyl.

20. The lubricant composition according to claim 17, wherein the fatty acid alkanolamide is a mixture of compounds of formula V, wherein about 15 to about 45% by weight of the fatty acid alkanolamide are compounds where $R^2$ is $C_{15}$ alkyl or alkenyl, about 40 to about 80% by weight of the fatty acid alkanolamide are compounds where $R^2$ is $C_{17}$ alkyl or alkenyl, and 0 to about 15% by weight of the fatty acid alkanolamide are compounds where $R^2$ is $C_{7-14}$, $C_{1-6}$ or $C_{18-19}$ alkyl or alkenyl.

21. The lubricant composition according to claim 17, wherein the fatty acid alkanolamide is prepared by reacting a di(hydroxyalkyl) amine with carboxylic acids or carboxylic acid derivatives from canola oil, corn oil, coconut oil, sunflower oil, soybean oil, lard, palm oil, beef tallow, cocoa butter, or illipe.

22. The lubricant composition according to claim 10, further comprising D) zinc dialkyldithiophosphate (ZDDP).

* * * * *